United States Patent [19]

La Fata et al.

[11] Patent Number: 4,481,731

[45] Date of Patent: Nov. 13, 1984

[54] AMUSEMENT DEVICE FOR MAKING BUBBLES

[75] Inventors: John E. La Fata, Oxnard; John D. Cuccio, Ojai, both of Calif.

[73] Assignee: Product Originators, Inc., Oxnard, Calif.

[21] Appl. No.: 482,634

[22] Filed: Apr. 6, 1983

[51] Int. Cl.[3] ..... A63H 33/28
[52] U.S. Cl. ..... 446/15
[58] Field of Search ..... 46/6, 7, 8

[56] References Cited

U.S. PATENT DOCUMENTS 2,527,935 10/1950 Joel ..... 46/6
4,180,938 1/1980 La Fata et al. ..... 46/6

FOREIGN PATENT DOCUMENTS 1413175 12/1965 France ..... 46/6
1329796 9/1973 United Kingdom ..... 46/6

*Primary Examiner*—Mickey Yu

[57] ABSTRACT

A bubble making wand with inner and outer generally concentric serrated rings for making a plurality of small bubbles inside of a single larger bubble. A pan having two reservoirs with shape complimentary to the shape of the wand is also described.

7 Claims, 7 Drawing Figures

AMUSEMENT DEVICE FOR MAKING BUBBLES

BACKGROUND OF THE INVENTION

The present invention relates to an amusement device and, more particularly, to a bubble making device which will form small bubbles inside of a large bubble.

The art of making bubbles as an amusement is quite old and well-developed. Typically, a bubble blowing wand having a generally circular ring at one end of the wand is immersed in a soap solution or the like of suitable viscosity and surface tension to create an adherent film of bubble blowing solution. The solution forms a meniscus which occupies the entire inner area of the ring which is then waved through the air or blown against to create bubbles. Attempts have been made to also create bubbles within a bubble as evidenced by U.S. Pat. No. 2,527,935, Joel which discloses a bubble blowing device comprising a wand having a pair of spaced loops of different diameter located in spaced parallel planes. The device must be generally vertically immersed into a reservoir of bubble blowing solution so that a meniscus of solution is formed across each of the rings. When the device is properly waved through the air, the bubble created from the smaller of the two loops will be positioned interiorly of the bubble produced from the larger loop.

A second prior art device invented by the inventors herein and disclosed in U.S. Pat. No. 4,180,938, La Fata et al, generally comprises a bubble blowing wand having spaced loops disposed in a common plane. In this invention the loops are provided with serrations such that a greater quantity of bubble blowing fluid will be retained on the loops therefore rendering the device more capable of creating the desired bubbles within a bubble. This patent also discloses a spillproof container having an elastomeric top provided with a slit therein for reception of the wand. The slitted spillproof container is provided for minimizing spillage of bubble blowing solution and its construction necessitates the use of a wand which is relatively thin in cross-section and thus precludes use of a wand such as the Joel wand where the loops or rings are disposed in spaced planes.

It is desired to provide a bubble blowing device which will create bubbles in a bubble of relatively large dimensions since bubbles of large size are more fragile and therefore are more difficult to create. They are relatively rare and thus desirable.

It is a further object to provide a device which is capable of creating large bubbles within a bubble and in which the wand can easily be loaded with a suitable quantity of bubble blowing solution without undue loss or spillage.

SUMMARY OF THE INVENTION

The present invention accordingly provides an amusement device which comprises a wand having a relatively large outer ring and relatively small inner ring, said rings being disposed in spaced generally parallel planes and having a handle attached thereto of special configuration and design such that the loading of the rings with bubble solution can be accomplished without undue loss or spillage.

Preferably, the rings of the bubble wand are connected together by a connector having first and second legs respectively connected to each of the rings, each of said first and second legs extending in a direction transverse to the plane of the rings such that rings are the sole parts of the device which occupy the planes in which they are disposed.

A specially designed pan for holding bubble blowing solution is also disclosed which is of complementary construction to that of the wand.

DETAILED DESCRIPTION

Figure 1:
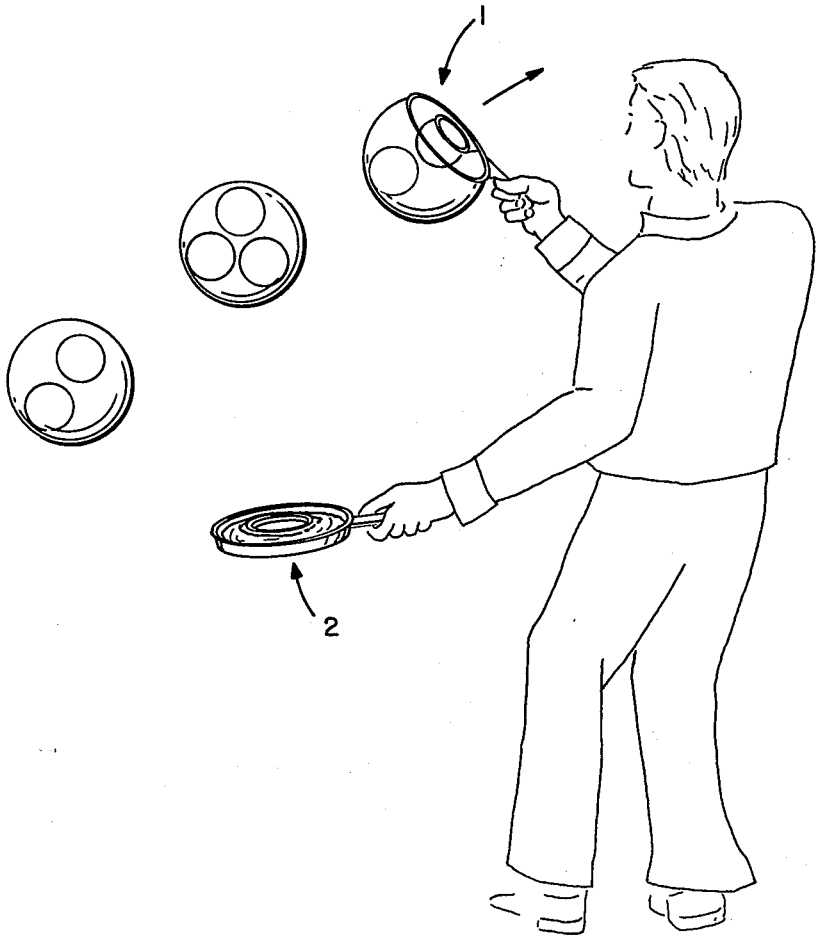
FIG. 1 is a perspective view of showing the mode of operation blowing bubbles within a bubble.

FIG. 1 shows an operator holding the wand 1 in his right hand and a pan 2 of complementary shape in his left hand. The wand 1 is loaded with bubble making solution in the pan 2 and, as the wand is waved through the air with the proper motion (smaller ring forward), it is possible to form small bubbles disposed generally concentrically inside of a large bubble. While the relative size of the bubbles is not critical, it has been found that relatively large size bubbles of up to about 24 inches (about 60 cm) diameter can be formed with a device as disclosed which has a diameter of only about 7 inches (about 20 cm) of its outer ring.

Figure 2:
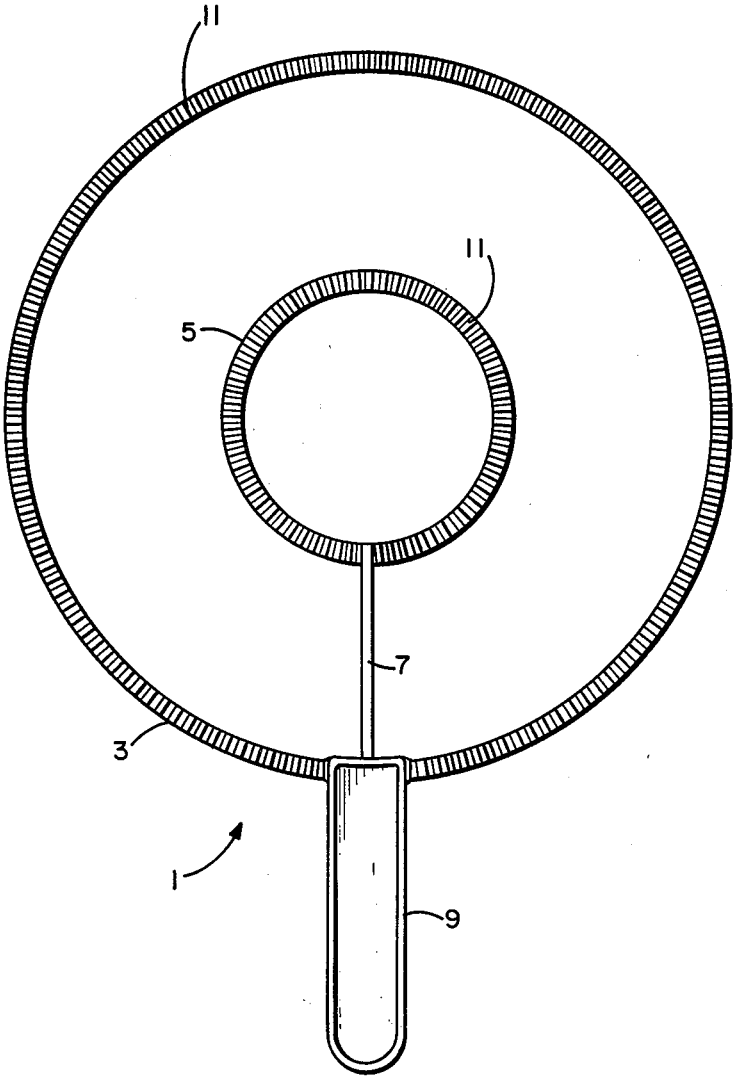
FIG. 2 is a plan view of the wand.

As seen in FIG. 2, the wand 1 comprises a large outer ring 3 connected to a smaller inner ring 5 by a radial arm 7. The wand 1 is grapsed by a handle 9 which, in the preferred embodiment, is radially aligned with the arm 7 although it will be appreciated by those skilled in the art that such radial alignment of the arm 7 and handle 9 is not essential. Such alignment does, however, provide structural rididity and, as seen in FIG. 4, the arm 7 generally tapers increasing in thickness from a location proximate its connection with the inner ring 5 to its connection to the outer ring 3.

Figure 4:
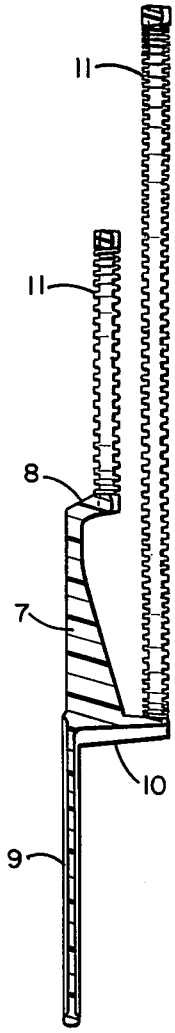
FIG. 4 is a side view, partly in cross-section of the wand.
Figure 3:
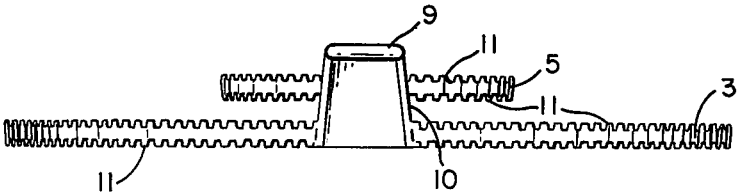
FIG. 3 is an elevational view of the wand taken from the end of the handle.

As seen in FIG. 4, the outer ring 3 is of generally planar construction and is spaced slightly below the plane of the inner ring 5. The actual spacing is not critical but, in practice, it has been found that with an outer ring diameter of approximately 7 inches and an inner ring diameter of approximately 2-$\frac{3}{4}$ inches, a vertical spacing between the rings of about $\frac{1}{2}$ inch works adequately. Preferably the ratio of the diameter of the outer ring 3 to the diameter of the inner ring 5 is about 3:1.

Figure 5:
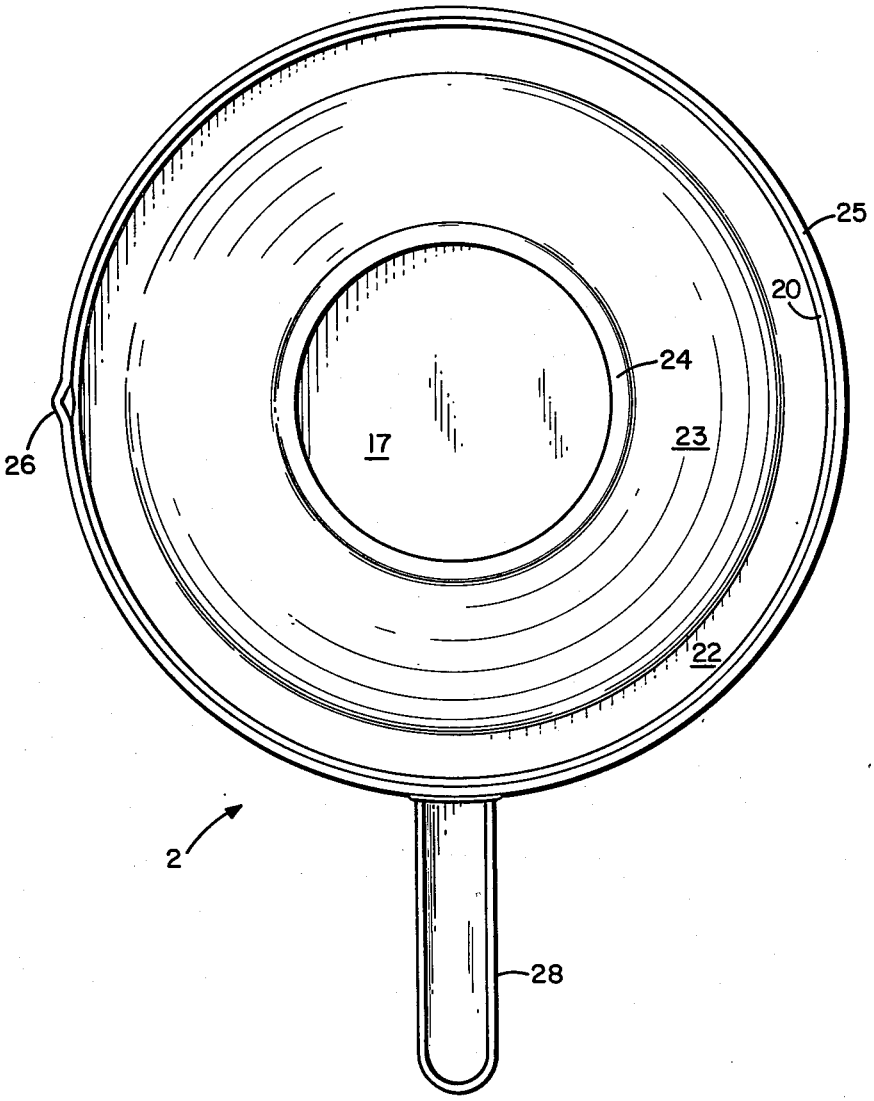
FIG. 5 is a plan view of the pan.

As best seen in FIGS. 4 and 5, the plane of the handle 9 is located slightly above the plane of the inner ring 5 so that the wand 1 can conveniently be loaded with bubble making solution from the pan 2 which will be described with reference to FIGS. 5, 6 and 7.

The radial support arm 7 is provided with a slight vertical extent or leg 8 best shown in FIG. 4 such that the inner ring 5 can be immersed into a reservoir of complementary shape in the pan (to be described) without interference between the radial arm 7 and the peripheral wall of the reservoir in the pan. Similarly, the arm 7 is provided with a second generally vertical leg 10 at its connection with the outer ring 3 such that the wand 1 can be dipped into the pan without interference between the handle 9 and a generally vertical wall of the pan which surrounds the reservoir portion into which the outer ring 3 is immersed.

Since there is a distinct relationship between the size of a bubble to be formed and the amount of bubble making solution required to form the bubble, it has been found that the wettable area of at least the outer ring 3 must be great enough depending on the size of the outer ring 3 to receive adequate bubble making solution to form a bubble. As previously mentioned the diameter of the bubble formed may be much larger than the diameter of the outer ring 3. For this purpose serrations 11 are provided on the upper and lower surfaces of the outer ring 3. It will be appreciated by those skilled in the art that serrations are only one means of increasing the wettable area of the outer ring 3 and that other equivalent means could be used such, for example, as a series of holes in the outer ring 3. In practice it has been found that radial serrations 11 of width slightly greater than one degree (1° 4′ 17″ in the preferred embodiment) on the outer ring work 3 adequately in practice.

The inner ring 5 is also provided with radial serrations 11 on the top and bottom surfaces thereof although it will be appreciated that since the size of the bubble formed by the inner ring is considerably smaller than that formed by the outer ring, serrations on the inner ring to increase the wettable area thereof are not always believed to be essential.

FIG. 5 is a plan view of the pan 2 which is constructed of complementary size and shape to the wand 1. As seen in FIG. 5, the pan 2 has an inner solution reservoir 13 defined by a generally circular vertical side wall 15 and a generally planar bottom wall 17 integrally connected to the side wall 15. The pan also includes an outer solution reservoir 19 generally defined by peripherally spaced outer and inner vertical walls 20, 21, and generally annular bottom wall 22. As seen in FIG. 6, the vertical wall 15 of the inner reservoir 13 is connected to the inner wall 21 of the outer solution reservoir 19 by a generally sloping drain wall 23 which in turn is provided with a short horizontal transition portion 24. The angle of slope of drain wall 23 is approximately the same as the angle of taper of the wand arm 7 seen in FIG. 4. This complementary shaping of the taper of the wand arm 7 and drain wall 23 of the pan 2 is particularly advantageous in that when the wand is constructed of easily distortable plastic material, distortion of the wand 1, particularly the spacing between the planes of the outer ring 3 and inner ring 5, is avoided because distortion is prevented by the interference between wand arm 7 and drain wall 23 as the wand, is immersed in pan 2 for filling.

Figure 6:
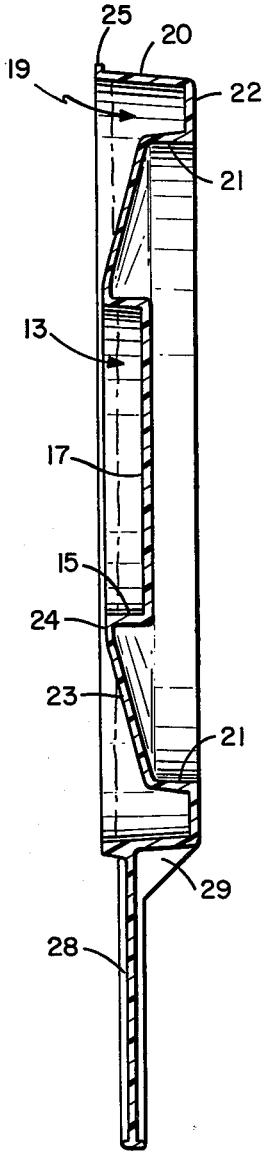
FIG. 6 is an elevation view, partly in crosssection, of the pan.
Figure 7:
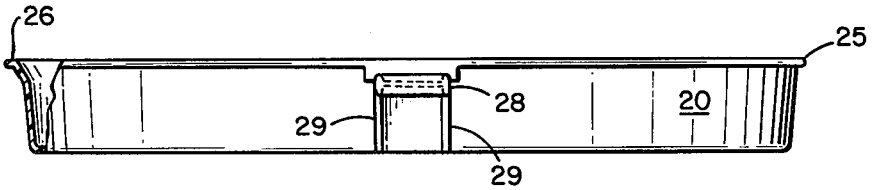
FIG. 7 is an elevation of the pan showing the end of the handle.

As can best be seen in FIG. 6, the outer wall 20 of pan 2 is disposed slightly above the upper edge of wall 15 which peripherally defines the inner fluid reservoir 13. The purpose of this construction is such that the pan 2 can be filled with liquid bubble making solution by pouring the liquid solution generally into the inner solution reservoir 13 which then overflows over the transition portion 24 and drainage wall 23 to begin filling the outer solution reservoir 19. When both reservoirs 13 and 19 are filled with an adequate quantity of bubble making solution, the device is ready for operation.

Preferably a circumferential edge portion or bead 25 is formed about the upper edge of chamber wall 20. The bead 25 is provided primarily for structural stability and lends stiffness to the construction.

A pouring lip 26 is also conveniently formed at a suitable location on wall 20 preferably spaced about 90° from the location of a handle 28 for pouring excess liquid bubble making solution back into a supply container if the pan 2 is inadvertently overfilled.

The handle 28 is integrally connected with the outer wall 20 of the pan and is preferably made of a web and flange type construction for stiffness with a pair of spaced chamfers 29 (FIGS. 6 and 7) between the handle 28 and pan wall 20 for added strength.

It has been found that the pan 2 can be integrally molded from polyethylene plastic material as a unitary construction and that the wand 1 can be formed in similar fashion. Thus the device can be constructed relatively inexpensively and, when properly operated, is capable of making bubbles of size larger than those heretofore known in the art.

In operation the wand 1 is loaded with bubble making solution by immersing it in the pan such that the outer ring 3 is received in the outer reservoir 19 and the inner ring 5 is received in the inner reservoir 13. Bubbles are formed by moving the device such that the plane of the small inner ring 5 precedes the plane of the larger outer ring 3 as the device is moved through the air such that bubbles formed from the meniscus of the small ring 5 are received within and enveloped by the bubbles formed from the plane of the meniscus of the large ring 3.

As will be readily appreciated, the complementary size and shape of the wand and pan permit the operator to easily load both rings of the wand simultaneously despite the fact that the rings are disposed in spaced parallel planes. Secondly, since the pan is relatively shallow in comparison with its diameter, it is not too heavy even when filled with solution to be comfortably held in one hand for repeated operation. Provision of the separate inner and outer reservoirs in the pan results in reduction in weight of the pan when filled with bubble making solution as compared with a conventional single reservoir pan construction.

During the loading operation, the novel construction of the sloping drain wall 23 in the pan operates in conjunction with the large ring 3 to ensure that a meniscus is formed in the large ring 3 as it is lifted from the pan 2.

Although the invention has been described in detail by way of illustration and example for purposes of clarity of understanding, it will be understood that certain changes and modifications may be practiced within the scope of the appended claims.

What we claim is:

1. An amusement device comprising a wand and a pan for use in making bubbles, said wand having:

(a) an outer ring disposed in a first plane;

(b) an inner ring disposed in a second plane generally parallel to and spaced from said first plane;

(c) an arm connecting said outer ring to said inner ring, said arm having a leg at either end thereof respectively connected to said inner ring and to said outer ring, said legs each being disposed generally transversely to the planes of said rings whereby said rings may be loaded with bubble making solution from a pan having separate reservoirs at different levels for receiving and loading said spaced rings; and (d) a handle, said pan having a pair of bubble making solution reservoirs of generally complimentary size and shape to said outer and inner rings of said wand for receiving said rings.

2. The amusement device of claim 1 wherein said handle is connected to said one of said legs which is connected to said outer ring.

3. The amusement device of claim 1 wherein at least the outer one of said rings has serrations thereon.

4. The amusement device of claim 1 wherein both said outer ring and said inner ring have serrations thereon for increasing the wettable area of the rings.

5. The amusement device of claim 4 wherein the diameter of the outer ring is approximately three times the diameter of the inner ring.

6. The amusement device of claim 1 wherein said pan includes (a) an inner solution reservoir defined by a bottom wall and a generally circular side wall of diameter slightly larger than the diameter of said inner ring;

(b) an outer solution reservoir defined by a bottom wall and a pair of circular side walls spaced apart slightly further than the width of said outer ring, said bottom wall of said outer solution reservoir being disposed in a plane spaced below the plane of the bottom wall of said inner solution reservoir a distance substantially equal to the spacing between the planes of said outer ring and said inner ring of said wand;

(c) an annular drain wall connecting and sloping downwardly from said circular side wall of said inner solution reservoir to the inner one of the circular side walls of said outer solution reservoir, for draining excess solution poured into said inner reservoir to said outer reservoir; and (d) a handle for said pan.

7. The amusement device of claim 6 where the arm which connects said outer ring of said wand to said inner ring thereof has a tapered extent of configuration complementary to the slope of said annular drain wall of said pan whereby said tapered arm engages said sloping drain wall as said wand is immersed in said pan for loading with bubble making solution.

* * * * *